US005577899A

United States Patent [19]

Phillips

[11] Patent Number: 5,577,899

[45] Date of Patent: Nov. 26, 1996

[54] HYDROSTATICALLY BALANCED GEAR PUMP

[75] Inventor: Edward H. Phillips, Troy, Mich.

[73] Assignee: Techco Corp., Southfield, Mich.

[21] Appl. No.: 252,739

[22] Filed: Jun. 2, 1994

[51] Int. Cl.[6] ..... F04B 39/06

[52] U.S. Cl. ..... 417/371; 418/72; 418/206.1

[58] Field of Search ..... 418/206.1, 206.7, 418/72, 74; 417/371, 410.4

[56] References Cited

U.S. PATENT DOCUMENTS

| | | | |
|---|---|---|---|
| 2,491,365 | 12/1949 | Ernst | 418/72 |
| 3,315,604 | 4/1967 | Roeske | 417/371 |
| 5,261,796 | 11/1993 | Niemiec et al. | 417/371 |

FOREIGN PATENT DOCUMENTS

| | | | |
|---|---|---|---|
| 593732 | 3/1960 | Canada | 417/410.4 |
| 713285 | 10/1931 | France | 418/72 |
| 705498 | 3/1941 | Germany | 418/72 |

*Primary Examiner*—Charles Freay
*Attorney, Agent, or Firm*—Gifford, Krass, Groh, Sprinkle, Patmore, Anderson & Citkowski, P.C.

[57] ABSTRACT

A gear pump is hydrostatically balanced by providing a plurality of coupling passages connecting diametrically opposed spaces formed between teeth of the gears. The coupling passages form pressure balancing fluid paths which serve to eliminate pressure differences between the diametrically opposed spaces. Additionally disclosed are balancing pistons which act on spindles supporting the gears. The balancing pistons are aligned to oppose resultant of the remaining forces. Additionally discloses is an eductor motor positioned within a fluid reservoir and connected for driving the gears.

2 Claims, 5 Drawing Sheets

HYDROSTATICALLY BALANCED GEAR PUMP

BACKGROUND OF THE INVENTION

I. Field of the Invention

The present invention relates generally to gear pumps, and more particularly, to gear pumps which are hydrostatically balanced.

II. Description of the Prior Art

In a gear pump, fluid is carried from an inlet port through a pumping chamber to an outlet port by a pair of meshed gears comprising a drive gear and a driven gear. Fluid enters the pumping chamber via filling a partial vacuum formed near the inlet port by unmeshing of the gear teeth. The fluid is carried in spaces formed between the gear teeth and the pumping chamber. The fluid is forced out of the pumping chamber and through the outlet port as the gears go back into mesh. Usually forces imposed upon the gears are substantially unbalanced. Included are forces due to increasing pressure of fluid moving around the pumping chamber toward the outlet port as well as any excess pressure formed by trapping or compression of fluid between meshing teeth. Also included are reaction forces proportional to drive torque imposed upon the driven gear by the drive gear. Because of these unbalanced forces, drive and driven gears of prior art gear pumps are generally provided with shafts supported by bearings on each side. Fabrication of such an assembly is expensive because of the accuracies required in providing necessary alignment of the various bearings, shafts and mechanical parts used in defining the pumping chambers.

It is known, as disclosed by Schwartz and Grafstern in *Pictorial Handbook of Technical Devices,* Chemical Publishing Co., Inc., New York, 1971, to provide pressure balancing fluid paths from the inlet port to first opposing chamber segments and the outlet port to second opposing chamber segments through first and second pairs of passages in the housing, respectively. However, such an arrangement does not completely balance the pressure imbalances and does not address the reaction forces at all. Accordingly, it is still necessary to utilize shafts and bearings to support the gears. Further, the first and second pairs of passages result in an enlarged housing that is more expensive to fabricate.

SUMMARY OF THE INVENTION

In a preferred embodiment, an improved gear pump comprising nominally balanced gears is shown. Shafts cantilevered from single bearings are utilized for supporting the gears. Nominal balance for each one of the gears is achieved by a plurality of coupling passages connecting diametrically opposed spaces formed between the teeth. The coupling passages form pressure balancing fluid paths which serve to eliminate pressure differences between the diametrically opposed spaces. However, torque reaction forces are still present and, as a result of partial space masking due to the meshing action of the gears, some pressure imbalance forces are also still present.

Therefore, in an alternative preferred embodiment, balancing pistons which act on spindles utilized for supporting gears in a balanced pump sub-assembly are shown. The spindles act upon bores formed within the gears to substantially oppose the remaining forces. This, in turn, permits the gears to be self guided within pumping chambers formed by a spacer plate and inner and outer side plates whereby no supporting shafts or bearings are utilized. The pistons are mounted in bores formed in the outer side plate. Each bore extends radially from its respective spindle in a direction parallel to the resultant of the sum of force imbalances on its respective gear.

BRIEF DESCRIPTION OF THE DRAWINGS

Other objects, features and advantages of the present invention will be apparent from the written description of the drawings, in which.

DETAILED DESCRIPTION OF THE PREFERRED EMBODIMENTS

Figure 1:
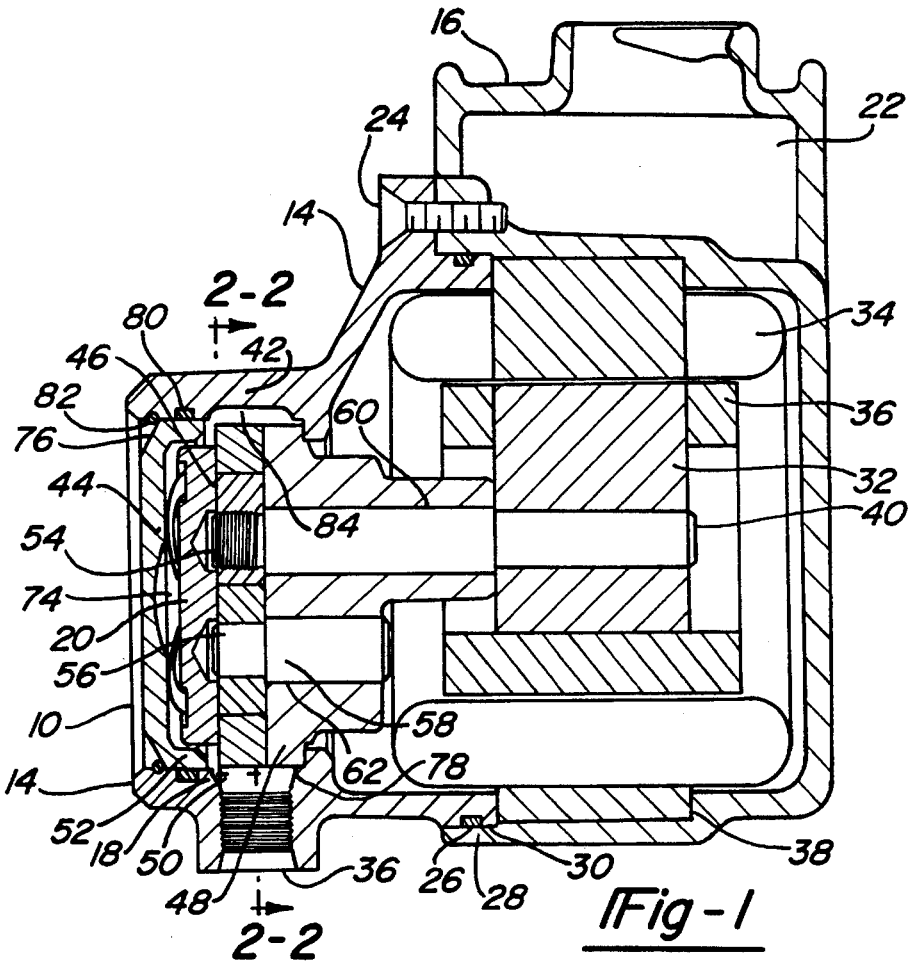
FIG. 1 is a cross-sectional view of a gear pump in accordance with the preferred embodiment of the invention.
Figure 2:
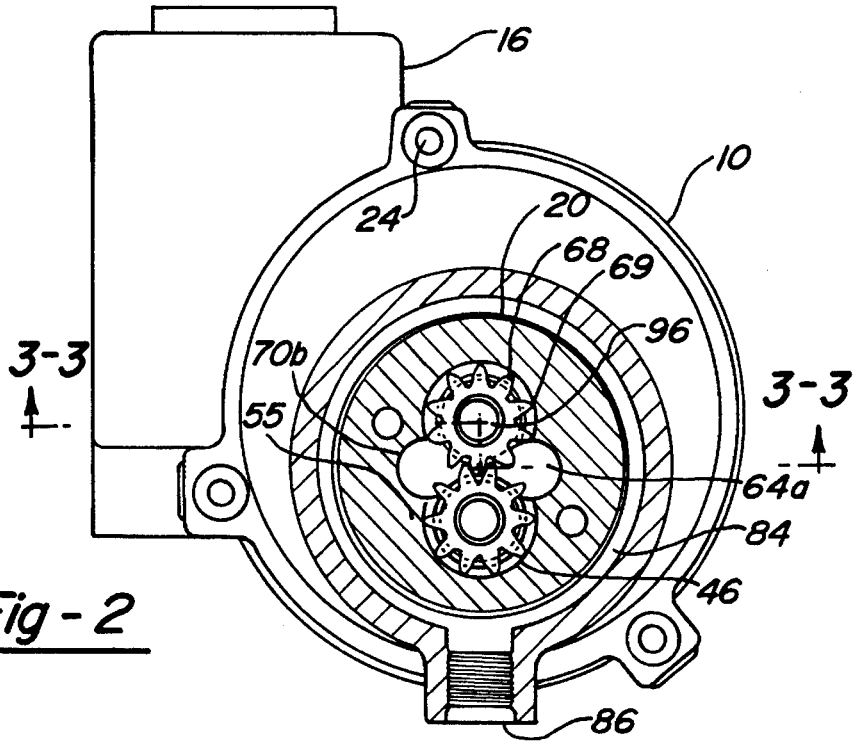
FIG. 2 is a cross-sectional plan view of the gear pump taken along lines 2—2 of FIG. 1.
Figure 3:
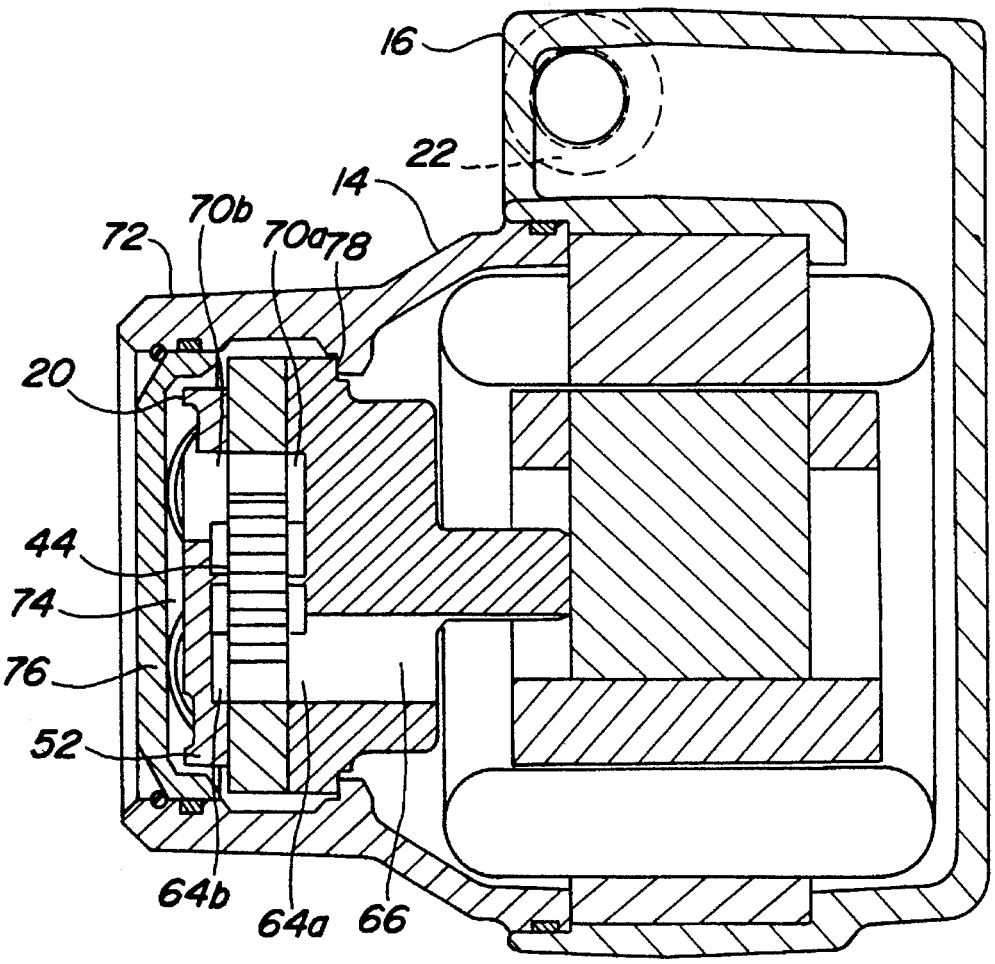
FIG. 3 is a cross-sectional plan view of the gear pump taken along lines 3—3 of FIG. 2.

As best shown in FIGS. 1, 2 and 3, a gear pump 10 in accordance with the preferred embodiment of the invention includes a housing assembly formed of pump housing 14 and shell member 16. Gear pump 10 is particularly adapted for use in supplying pressurized fluid for use to a power steering system (not shown). Although gear pump 10 is particularly suited for power steering systems, principles of the invention may be applied to any gear pump. Pump housing 14 has a generally cylindrical portion 18 defining a cavity for accepting a pump sub-assembly 20. A reservoir of fluid is formed in a chamber 22 defined by shell member 16 and pump housing 14. Shell member 16 is secured to pump housing 14 by bolts 24 and is sealed by O-ring 26 mounted in groove 28 formed in flange 30 extending from pump housing 14.

Gear pump 10 also comprises an induction motor 32 which is mounted within chamber 22. The induction motor 32 includes stator 34 and rotor 36. Stator 34 is mounted between annular lip 38 of shell member 16 and flange 30 of pump housing 14. Rotor 36 is pressed or shrunk fit upon drive shaft 40 which turns drive gear 42 and then driven gear 44.

Pump sub-assembly 20 further includes counter shaft 58 and pumping chambers 46 formed between inner side plate 48, spacer plate 50 and outer side plate 52. Pumping chambers 46 are formed in the shape of a pair of overlapped circles and extend axially through the spacer plate 50 between inner and outer side plates 48 and 52, respectively. As best shown in FIG. 2, pumping chambers 46 are formed to accommodate gears 42 and 44 with minimal leakage either around tips 69 of teeth 68 or gear faces 96. Gears 42 and 44 are pressed or shrunk fit upon small ends 54 and 56 of drive shaft 40 and counter shaft 58, respectively.

Axial bores 60 and 62 are formed in inner side plate 48 to provide journal bearings for drive shaft 40 and counter shaft 58. Performance of the journal bearings may be enhanced via the inclusion of hydrodynamic fluid pumping grooves (not shown) formed according to principles explained under a general subject entitled *Pumping Bearings* in *Gas Film Lubrication* by W. A. Gross published by Wiley. (Although the general subject matter of that book is gas film lubrication, much of the matter discussed therein assumes isothermal, non-compressible fluid and is applicable to liquid fluids as well.) Drive shaft 40 and counter shaft 58, and therefore gears 42 and 44, respectively, are located with reference to pumping chamber 46 via inner side plate 48 and spacer plate 50 being held in precise alignment by dowel pins 55.

As particularly shown in FIGS. 2 and 3, fluid flows from chamber 22 to mirror imaged inlet ports 64*a* and 64*b* formed in inner and outer side plates 48 and 52, respectively, via axial inlet passage 66 and adjacent spaces formed between teeth 68 of gears 42 and 44 as they unmesh. The incoming fluid is induced to fill these spaces via a partial vacuum created therein by the unmeshing of gears 42 and 44. It is then carried around the pumping chamber 46 until the spaces are adjacent to outlet ports 70*a* and 70*b* formed in inner and outer side plates 48 and 52, respectively. As the fluid completes its passage around the pumping chamber 46 it becomes pressurized fluid via being forced through axial outlet passage 72 into a pressure chamber 74 as the spaces collapse due to meshing of gears 42 and 44. The pressurized fluid in the pressure chamber 74 maintains the pump sub-assembly 20 in axial position against shoulder 78 of pump housing 14. Pressure chamber 74 is formed between outer side plate 52 and cover plate 76 which is retained by retaining ring 80 and sealed by O-ring 82. Finally, the pressurized fluid is delivered to a host hydraulic system (not shown) via annular channel 84 and output port 86.

Figure 4A:
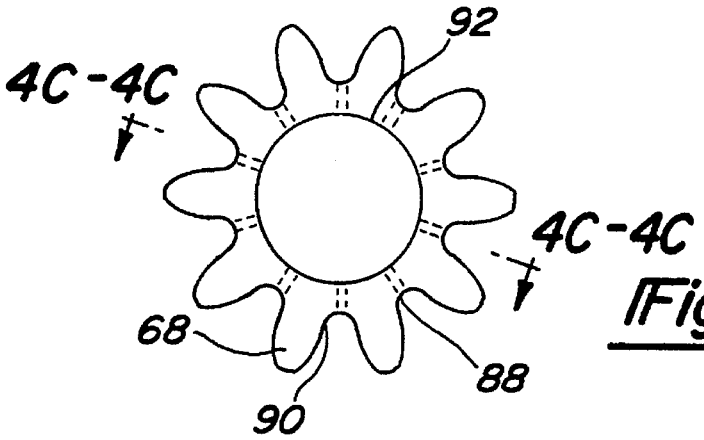
FIG. 4A is a plan view of a gear of the pump in accordance with the preferred embodiment of the invention.
Figure 4B:
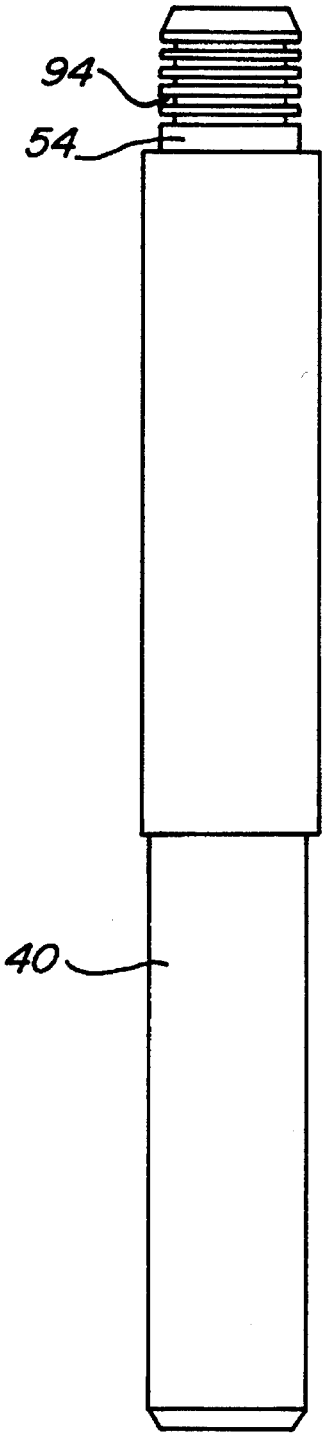
FIG. 4B is a side view of a shaft of the pump in accordance with the preferred embodiment of the invention.
Figure 4C:
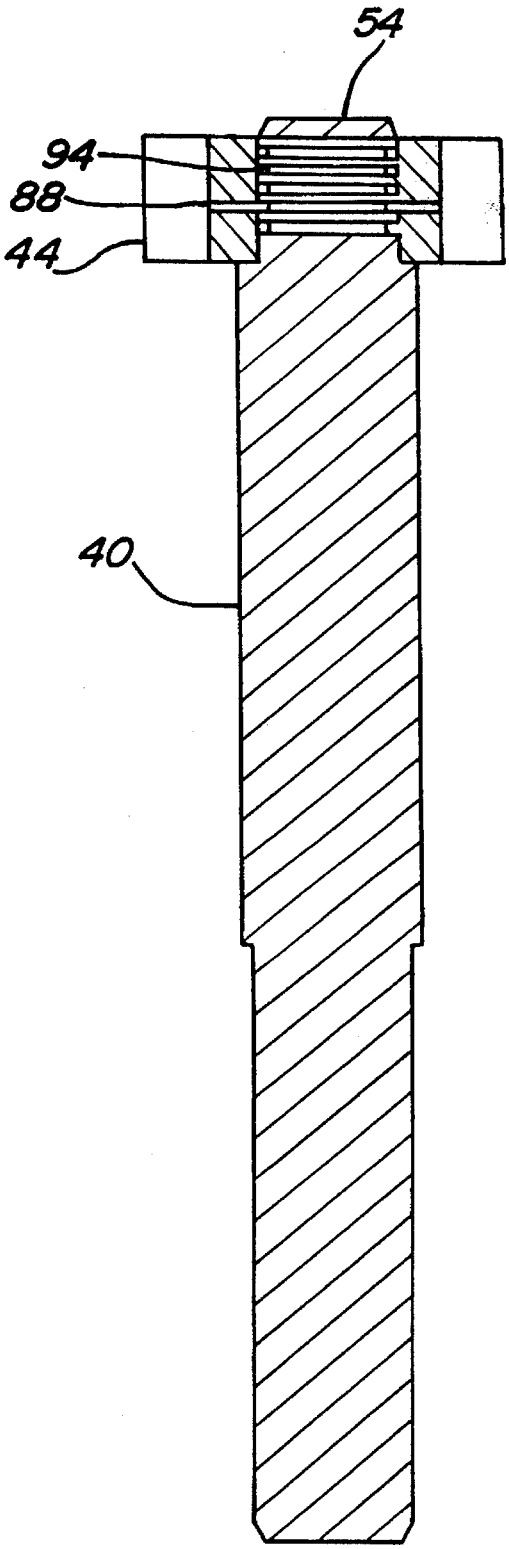
FIG. 4C is a cross-sectional view along lines 4C—4C of FIG. 4A showing an assembled gear and shaft of the pump in accordance with the preferred embodiment of the invention.

With reference now to FIGS. 4A, 4B and 4C, gears 42 and 44 are each formed with an even number of teeth 68 wherebetween radially directed bores 88 connect lands 90 to bores 92. Radially directed bores 88 are formed in oppositely aligned pairs which are spaced in the axial direction. Small ends 54 and 56 of drive shaft 40 and counter shaft 45, respectively, are each formed with axially spaced circumferential grooves 94 located such that each is substantially in axial alignment with one pair of radially directed bores 88 when gears 42 and 44, respectively, are pressed or shrunk fit thereupon. (Although circumferential grooves are depicted as being formed in small ends 54 and 56 of drive shaft 40 and counter shaft 45, respectively, they could also be formed within bores 92.) As shown in FIG. 4C, opposite ones of the spaces between teeth 68 are thus interconnected to form pressure balancing fluid paths and nominally hydrostatically balance gears 42 and 44 during operation of gear pump 10.

Other details of pump sub-assembly 20 which are necessary but not shown include a suitably vented reservoir cap, pump output fitting, return fitting (i.e., to chamber 22) and electrical connection from an inverter (also not shown) to induction motor 32. In particular, the electrical connection from the inverter to induction motor 32 must be accomplished in a manner that protects both the general environment and the inverter from unacceptable levels of electromagnetic interference.

In operation, the rotor 36 of inductor motor 32 turns drive shaft 40, drive gear 42 and driven gear 44. Radially directed forces from the drive motor, drive torque reaction forces and/or residual forces still present as a result of partial space masking due to the meshing action of gears 42 and 44, are supported by the journal bearings. Gears 42 and 44 (as well as drive and counter shafts 40 and 58, respectively, and rotor 36) are located axially by selected clearance between gear faces 96 and inner and outer side plates 48 and 52, respectively. In any case, lower valued radial gear forces achieved via the above described nominal hydrostatic balance of gears 42 and 44 permits cantilevered shafts with single journal bearings to be used in gear pump 10. The resulting device is highly efficient and compact, and particularly suited for use with a power steering system of electric automobiles. With this arrangement, it is neither necessary to provide the outer side plate 52 to close tolerances nor to closely align it to the rest of the pump sub-assembly 20, thereby reducing the relative expense of gear pump 10.

Figure 5:
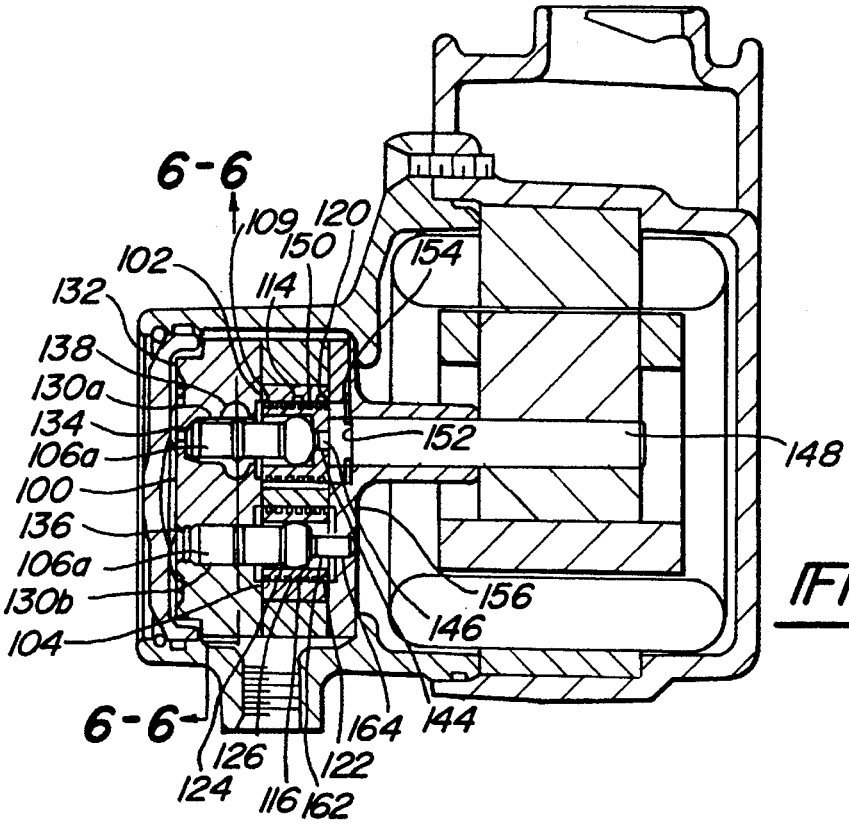
FIG. 5 is a cross-sectional view of a balanced pump sub-assembly in accordance with the alternate preferred embodiment of the invention.
Figure 6:
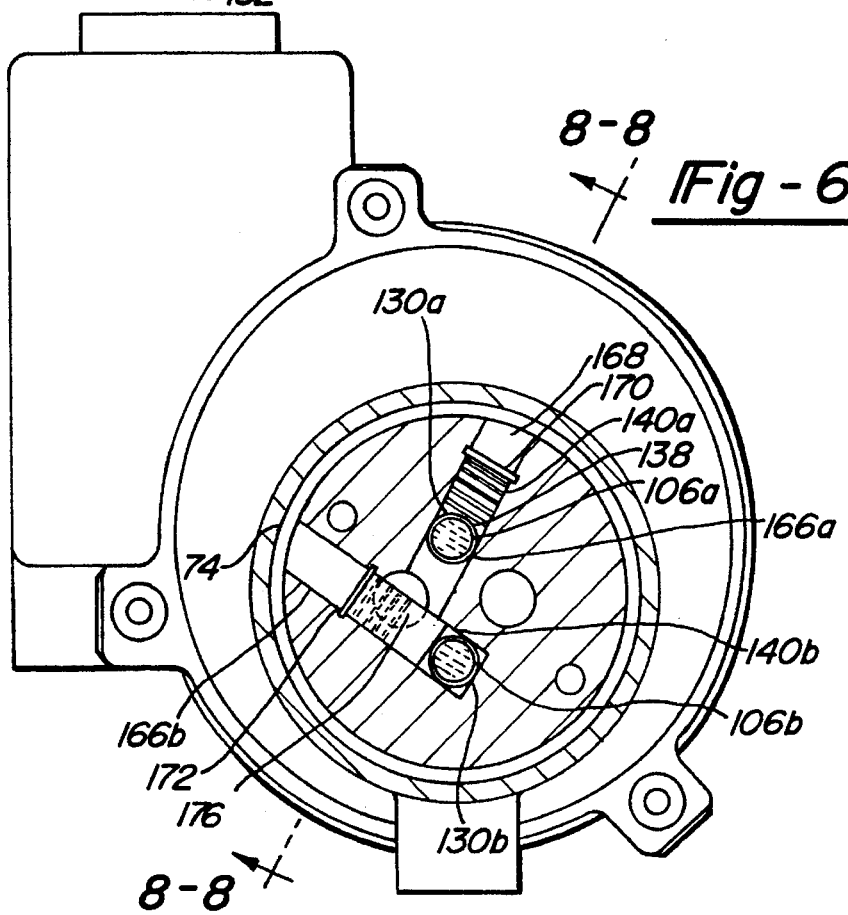
FIG. 6 is a cross-sectional plan view of the balanced pump sub-assembly taken along lines 6—6 of FIG. 5.
Figure 7:
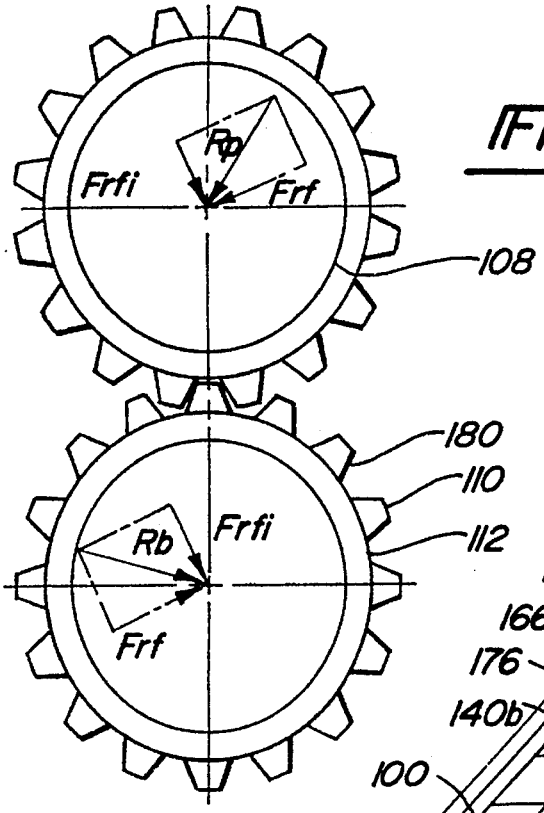
FIG. 7 is a view of the pair of gears shown in FIG. 5.

As shown in FIGS. 5, 6, 7, 8 and 9, a pump sub-assembly 100 in accordance with the alternate preferred embodiment of the invention comprises drive and driven gears 102 and 104, respectively, that rotate upon first and second spindles 106*a* and 106*b*, respectively. As best shown in FIGS. 5 and 7, each of the gears 102 and 104 have an enlarged center bore 108. An even number of teeth 110 extend around the outer circumference of gears 102 and 104. Similarly to the hydraulic connection provided by oppositely aligned pairs of radially directed bores 88 shown in FIG. 4A, lands 112 are connected with center bore 108. In pump sub-assembly 100 it is usually convenient to use a larger number of teeth 110 having stub profile and longer axial length. As described above, each pair of holes 114 are in alignment with one of an equal number of grooves 116 formed on outer surface 118 of inner sleeve 120 or 122 to form connecting passages between diametrically opposed pairs of lands 112. Thus, fluid pressure present in diametrically opposed spaces thereabove is substantially equal, thus effecting nominal hydrostatic balance for gears 102 and 104.

Figure 8:
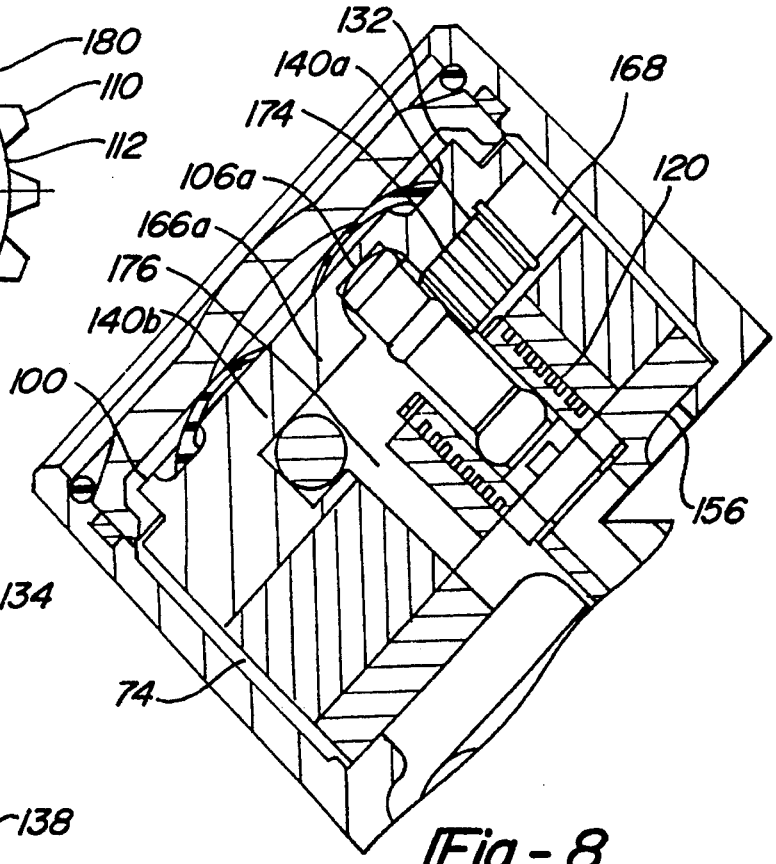
FIG. 8 is a cross-sectional plan view of the balanced pump sub-assembly taken along lines 8—8 of FIG. 6.

The above described remaining imbalance forces on gears 102 and 104 are supported via internal bores 124 of inner sleeves 120 and 122 bearing upon bearing mounted semi-spherical sleeves 126 which revolve about first and second spindles 106*a* and 106*b*, respectively. The spindles 106*a* and 106*b* are housed in axial bores 130*a* and 130*b*, respectively, of outer side plate 132. The spindles 106*a* and 106*b* have first semi-spherical surfaces 134 on an opposite end for support within a diametrically reduced section 136 of axial bores 130*a* and 130*b*. Spindles 106*a* and 106*b* also have second semi-spherical surfaces 138 for engagement with first and second balancing pistons 140*a* and 140*b* as discussed below. As shown in FIGS. 5 and 8, spindle 106*a* is positioned axially by end 150 of drive shaft 148 which, in turn, is positioned axially by retaining ring 152 and washer 154 between inner side plate 156 and cylindrical extension 158 of pump housing 160, respectively. Inner sleeve 120 (and therefore drive gear 102) is driven rotationally from rectangular hole 144 by drive tang 146 extending from drive shaft 148. As shown in FIG. 5, driven gear 104 and spindle 106*b* are positioned axially by spacing rod 162 mounted in bore 164 of inner side plate 156.

As best shown in FIGS. 6, 7, and 8, the remaining imbalance forces due to torque and the masking of fluid pressure by the meshing of teeth 110 may also be countered by first and second balancing pistons 140*a* and 140*b*, respectively, mounted in first and second pressure cylinder bores 166*a* and 166*b*, respectively. Pressure cylinder bores 166*a* and 166*b* extend radially across respective axial bore 130*a* or 130*b*. Pressure cylinder bores 166*a* and 166*b*, and therefore first and second balancing pistons 140*a* and 140*b*, are in line with second semi-spherical surfaces 138 of spindles 106*a* and 106*b*. A passage 168 conveys pressurized fluid from pressure chamber 74 to end 170 of first pressure cylinder bore 166*a*. Similarly, a second passage 168 (not shown) conveys pressurized fluid from pressure chamber 74 to 172 of second pressure cylinder bore 166*b*. Thus, pistons 140*a* and 140*b* engage semi-spherical surfaces 138 with forces proportional to pump output pressure. Accordingly, the pressure cylinder bores 166*a* and 166*b*, and respective ones of pistons 140*a* and 140*b*, are positioned parallel but in directions opposed to the respective resultant forces of the sums of the reaction forces due to the masking of fluid pressure by the meshing of the teeth 110. Further, following the procedure outlined below, the diametral size of each of pressure cylinder bores 166*a* and 166*b*, and respective pistons 140*a* and 140*b*, is chosen so as to optimally balance the resultant forces.

As shown in FIG. 7, normalized reaction forces (i.e., force divided by pump output pressure) on each gear due to torque applied by drive gear 102 to driven gear 104 are calculated as follows:

$$F_{rf}/P=(q/r_p)/2=al[in^2]$$

where $F_{rf}$ is reaction force, P is developed pressure, q is volumetric displacement per radian, $r_p$ is pitch radius, 2 represents the fact that only half the total drive torque is transmitted to driven gear 104, a is the gear addendum and 1 is gear length.

The average normalized radial force imbalance occurs due to the meshing of gear teeth. The meshing gears mask pressure from a portion of the tooth center line-to-tooth center line interval and is nominally calculated as follows:

$$F_{rf}/P=(\pi r_p 1)/(2N)[in^2]$$

where $F_{rf1}$ is radial force imbalance and N is number of teeth on either gear. If the gears have normal proportions, $a=(2r_p)/N$ and $$F_{rf1}/P=(\pi a1)/4[in^2] \text{ or } f_{xf1}=(\pi/4)F_{rf}[in^2].$$

Resultants $R_a$ and $R_b$ are then calculated and are generally in the positions shown in FIG. 7. Resultants $R_a$ and $R_b$ are the forces that must be applied by the pistons 140*a* and 140*b* in order to counteract the imbalance forces $F_{xf}$ and $F_{rf1}$. The first and second pressure cylinder bores 166*a* and 166*b*, respectively, are then disposed parallel to their respective resultant $R_a$ or $R_b$ as shown. The diametral size of each of pressure cylinder bores 166*a* and 166*b*, and respective pistons 140*a* and 140*b*, is chosen such that their areas counteract the product of the respective resultants and the lever length ratio computed by the distance between first semi-spherical surface 134 and second semi-spherical surface 138 divided by the distance between first semi-spherical surface 134 and semi-spherical sleeve 126.

As best shown in FIG. 8, pistons 140*a* and 140*b* have grooves 174 to permit fluid to extend therearound for lateral balance within pressure cylinder bores 166*a* and 166*b*, respectively. Pressure cylinder bores 166*a* and 166*b* intersect each other at a point 176 which is vented to low fluid pressure through first axial bore 130*a*. Thus, second piston 140*b* is not required to have grooves 174 on its non-pressurized end 178.

As shown in an exaggerated manner in FIG. 7, smooth rotational operation of gears 102 and 104 is aided by lead-in ramps 180 formed in the leading edges of each of the overlapped circles which define pumping chambers 46' used in pump sub-assembly 100. With the arrangement described above, it is not necessary to produce or align either of side plates 132 or 156 to close tolerances, thereby reducing the relative expense of pump sub-assembly 100.

Figure 9:
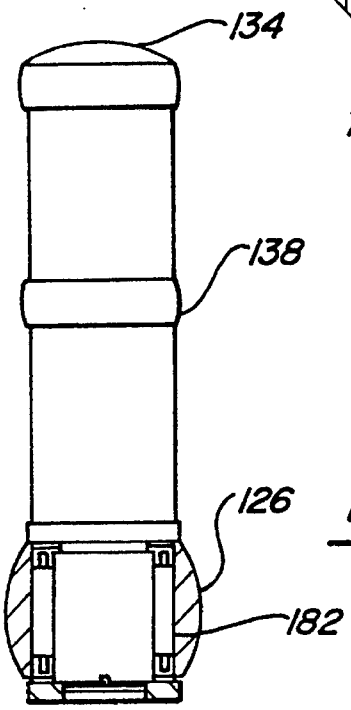
FIG. 9 is a cross-sectional view of a spindle of the balanced pump sub-assembly in accordance with the alternate preferred embodiment of the invention.

FIG. 9 shows an enlarged partially cross-sectional veiw of spindle 106*a* or 106*b*. Semi-spherical sleeve 126 is supported for rotation by needle bearing 182.

I claim:

1. A gear pump for producing a pressurized flow of fluid, said pump comprising:

a housing having an inlet passage and an outlet passage;

a pair of gears rotatably mounted within said housing, said pair of gears forming a mesh having an inlet side and an outlet side, said inlet side of said mesh being in fluid communication with said inlet passage and said outlet side being in fluid communication with said outlet passage;

means for hydrostatically balancing radial forces acting on said pairs of gears and having a pair of pistons mounted in said housing, each of said pistons operable for providing a balancing force to the respective one of said gears; and means for rotatably driving one of said pair of gears.

2. The pump of claim 1, wherein said means for balancing additionally comprises elongated members, each of said elongated members transversely movable within a bore and operable for transmitting said balancing force from the respective one of said pistons to the respective one of said gears.

* * * * *